US008104960B2

(12) United States Patent
Gill et al.

(10) Patent No.: US 8,104,960 B2
(45) Date of Patent: Jan. 31, 2012

(54) SEALABLE AND DISPOSABLE RECEPTACLE FOR BIOLOGIC WASTE PRODUCTS

(76) Inventors: Zora Singh Gill, Bakersfield, CA (US); Nichhater Singh Gill, Brampton (CA)

( * ) Notice: Subject to any disclaimer, the term of this patent is extended or adjusted under 35 U.S.C. 154(b) by 0 days.

(21) Appl. No.: 12/750,567

(22) Filed: Mar. 30, 2010

(65) Prior Publication Data

US 2010/0278456 A1 Nov. 4, 2010

Related U.S. Application Data

(60) Provisional application No. 61/164,782, filed on Mar. 30, 2009.

(51) Int. Cl.
*B65D 33/00* (2006.01)
*B65D 30/24* (2006.01)
*B65D 33/28* (2006.01)

(52) U.S. Cl. ..... 383/36; 383/44; 383/49; 383/72

(58) Field of Classification Search ..... 383/36, 383/44, 46, 48, 49, 52, 72, 75, 93; 4/144.2
See application file for complete search history.

(56) References Cited

U.S. PATENT DOCUMENTS 1,809,259 A * 6/1931 Williams ..... 383/49
3,189,252 A * 6/1965 Miller ..... 383/57
3,403,410 A * 10/1968 Benzel et al. ..... 4/144.2
3,471,871 A * 10/1969 Nociti et al. ..... 4/484
3,724,461 A * 4/1973 Eisenberg ..... 604/262
3,797,734 A * 3/1974 Fleury et al. ..... 383/36
3,920,179 A * 11/1975 Hall ..... 604/317
4,990,145 A * 2/1991 Fleury ..... 604/317
5,056,932 A * 10/1991 Young ..... 383/36
5,067,821 A * 11/1991 Young ..... 383/36
5,116,139 A * 5/1992 Young et al. ..... 383/49
5,354,132 A * 10/1994 Young et al. ..... 383/49
5,356,398 A * 10/1994 Willis ..... 604/321
5,368,583 A * 11/1994 Fleury ..... 604/318
6,116,780 A * 9/2000 Young et al. ..... 383/44
7,530,121 B2 * 5/2009 Snider ..... 4/144.2
2002/0193762 A1 * 12/2002 Suydam ..... 604/327

* cited by examiner

*Primary Examiner* — Jes F Pascua
(74) *Attorney, Agent, or Firm* — James M. Duncan, Esq.; Klein, DeNatale, Goldner, Cooper, et al.

(57) ABSTRACT

A portable and sealable waste disposal receptacle receives human waste material through an opening in an outer chamber. The waste passes through an inner chamber, which is suspended within the outer chamber, and passes through a one-way valve located at the bottom of the inner chamber into a lower chamber portion of the outer chamber. The one-way valve is fashioned from the bottom edges of the inner chamber, where a biasing strip is mounted in compression along one of the bottom edges, which causes the bottom edges of the inner chamber to be biased closed in sealing contact except when waste enters the inner chamber, the weight of which is sufficient to overcome the closing bias of the biasing strip, allowing the waste to flow into the lower chamber. Once the waste has cleared the inner chamber, the biasing member causes the bottom edges to come together in sealing contact, preventing the flow of waste back through the inner chamber.

16 Claims, 8 Drawing Sheets

SEALABLE AND DISPOSABLE RECEPTACLE FOR BIOLOGIC WASTE PRODUCTS

CROSS-REFERENCE TO RELATED APPLICATION

This application claims domestic priority to U.S. Provisional Patent Application 61/164,782 filed on Mar. 30, 2009.

BACKGROUND

The disclosed device generally relates to disposal devices for the collection of biologic wastes, and more particularly for the sanitary and convenient entrapment of various human waste materials, including vomit, urine, feces, sputum, etc. for eventual disposal.

While it is preferable to dispose of human waste material into a plumbed waste fixture such as a toilet, urinal, sink, etc., people are often unpleasantly surprised by the need to expel various waste products in an abrupt and urgent manner. For example, people are frequently subjected to stresses, both internal and external, which can cause vomiting, such as motion sickness induced within an automobile, airplane, boat, etc., or resulting from illness, food poisoning and other causes. Even if a lavatory is available, people riding in these conveyances are often unable to reach these facilities in sufficient time to evacuate the waste into the appropriate receptacle. Patients in hospitals may find themselves in a similar predicament, particularly where a particular illness and/or medication induce the need to evacuate the waste product.

The generally used portable and disposable receptacles for vomit and other human wastes are typically simple open-ended containers, subject to being upended and the contents released. Open-ended containers also allow the free release of odors from the waste material. The presently disclosed apparatus provides a superior means for retaining the waste material within the disposable receptacle.

SUMMARY OF THE INVENTION

A portable and sealable waste disposal receptacle receives human waste material through an opening in an outer chamber. The waste passes through an inner chamber, which is suspended within the outer chamber, and passes through a one-way valve located at the bottom of the inner chamber into a lower chamber portion of the outer chamber. The one-way valve is fashioned from the bottom edges of the inner chamber, where a biasing strip is mounted in compression along one of the bottom edges, which causes the bottom edges of the inner chamber to be biased closed in sealing contact except when waste enters the inner chamber, the weight of which is sufficient to overcome the closing bias of the biasing strip, allowing the waste to flow into the lower chamber. Once the waste has cleared the inner chamber, the biasing member causes the bottom edges to come together in sealing contact, preventing the flow of waste back through the inner chamber.

The disclosed portable and sealable waste disposal receptacle comprises a flexible outer layer of material which is impervious to water and the various bodily fluids the device may contain. This material forms an outer chamber having an open top and a closed bottom. The outer chamber will typically be fashioned in the shape of a bag, cylinder, or similar shape having a longitudinal axis substantially larger than the cross-wise axis. The apparatus further comprises an inner chamber, which is wholly disposed within the outer chamber. Because the inner chamber primarily transfers waste from the open top of the outer chamber to a lower chamber of the outer chamber, the inner chamber is referred to hereinafter as an "inner conduit." The inner conduit, fashioned from a flexible material, which depends from the outer chamber, typically on the inside surface near the open top of the outer chamber. The top of the inner conduit is circumferentially attached to the inside surface of the outer chamber, forming a circumferential seal at the point of attachment, such that the inner conduit provides a single pathway for waste material introduced into the top of the outer chamber into a lower chamber located beneath the bottom of the inner conduit. Waste material received into the apparatus is received and maintained in the lower chamber until such time as the receptacle is disposed.

The bottom of the inner conduit is fashioned to have a valve at its bottom end, the valve permitting flow in one direction into the lower chamber. This valve may comprise a flexible extension member compressibly disposed at the bottom of the inner conduit, which applies sufficient biasing force to maintain the valve in a closed position until such time as waste material enters the inner conduit. The valve at the bottom of the inner conduit restricts flow in the other direction, thus preventing the waste material from spilling from the device. The various components of the device are preferably fashioned from biodegradable plastics to facilitate responsible disposal of the waste material and the apparatus.

DETAILED DESCRIPTION OF THE EMBODIMENTS

Figure 1:
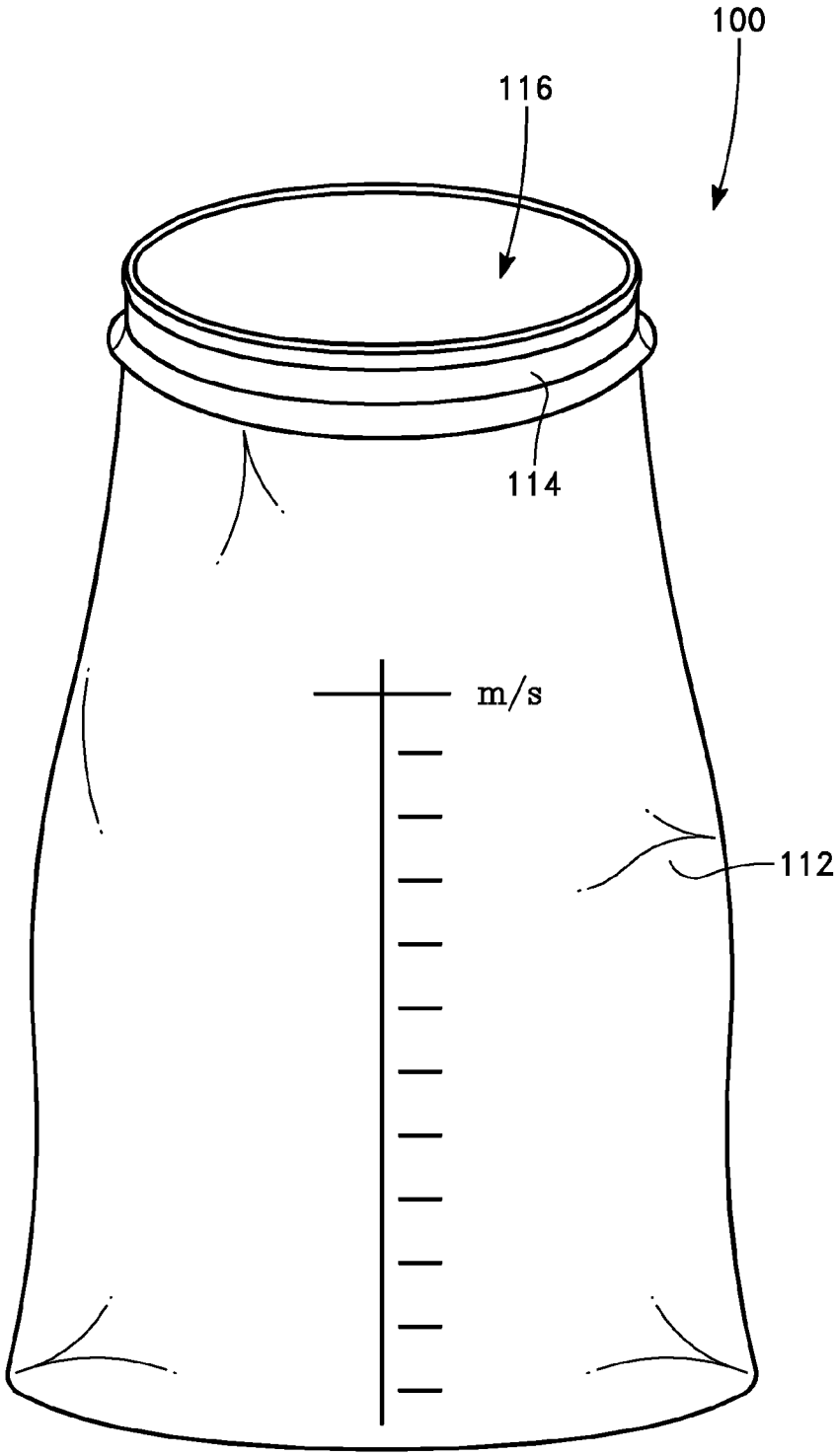
(Prior Art) FIG. 1
FIG. 1 shows a prior art disposable waste bag, wherein the upper edge is kept open by a rigid plastic member.

Referring now to the figures, FIG. 1 shows a prior art portable human waste receptacle 100, while FIGS. 2 through 10 show various views of embodiments of the disclosed sealable and disposable waste receptacle 10.

The prior device 100 as shown in FIG. 1 has a flexible lower bag 112 and a rigid upper plastic or similar material ring 114 that serves to retain the mouth 116 of the bag 112 in an open position. The ring 114 could be removed to allow a medical practitioner to attempt to tie the bag shut or otherwise effect a closure of the bag following its intended use.

With reference to FIGS. 2 through 10, the disclosed apparatus 10 comprises a flexible outer layer formed from material which is impervious to water and the various waste materials which are placed in the device. The flexible outer layer is fashioned into an outer chamber 12 having an open top 14 and a closed bottom 16. As suggested by the Figures, the outer chamber 12 will typically be fashioned in the shape of a bag, cylinder, or similar shape having a longitudinal axis L1 substantially larger than the cross-wise axis L2. The outer chamber 12 further comprises a lower chamber 24 for receiving and storing waste. The walls of the outer chamber adjacent to the lower chamber 24 may comprise various indicia 32 to indicate the volume of waste stored in the lower chamber to assist in ascertaining when the device is full.

The apparatus further comprises an inner conduit 18, fashioned from a flexible material, the top of which inner conduit may be flush with the top 14 of the outer chamber or which, alternatively, depends from the inside surface of the outer chamber 12, typically near the open top of the outer chamber. Thus, the inner conduit 18 is suspended within the outer chamber 12. The top 20 of the inner conduit 18 is circumferentially attached to the inside surface of the outer chamber 12, forming a circumferential seal 22 at the point of attachment, such that the inner conduit provides a single pathway for waste material introduced into the top of the outer chamber into a lower chamber 24 located beneath the bottom 26 of the inner conduit 18. Waste material W received into the apparatus 10 is received and maintained in the lower chamber 24 until such time as the receptacle is disposed.

The peripheral edges at the top 20 of the inner conduit 18 define the opening of the inner conduit. The peripheral edges at the top 20 are fused or otherwise attached to the top of the outer chamber 12 or to the inside surface of the outer chamber sufficient to suspend the inner conduit 18 from the top of the outer chamber as shown in the various figures. The attachment means utilized to attach the top 20 of the inner conduit 18 to the inside surface of the outer chamber 12 form a circumferential seal 22, which is a liquid tight seal between the top of the inner conduit and the inside wall of the outer chamber 12, such that material cannot escape from the device between the annulus 39 formed between the inner conduit 18 and the outer chamber 12. The bottom 26 of inner conduit 18 is sufficiently above the bottom of the lower chamber 24 to provide sufficient volume for storage of waste material M.

The bottom 26 of the inner conduit 18 is fashioned to function as a "valve" by the engagement and separation of its side walls 30, 31 with respect to each other, the valve 28 permitting flow in one direction through the inner conduit into the lower chamber 24. The normally closed valve 28 is opened by the weight of waste W exerting a downward and sideways force at the bottom 26 of the inner conduit sufficient to overcome the biasing force keeping the valve closed. The valve 28 restricts flow in the other direction, thus preventing the waste material W from flowing out of the lower chamber 24 back through the inner conduit 18 and spilling from the device.

Figure 2A:
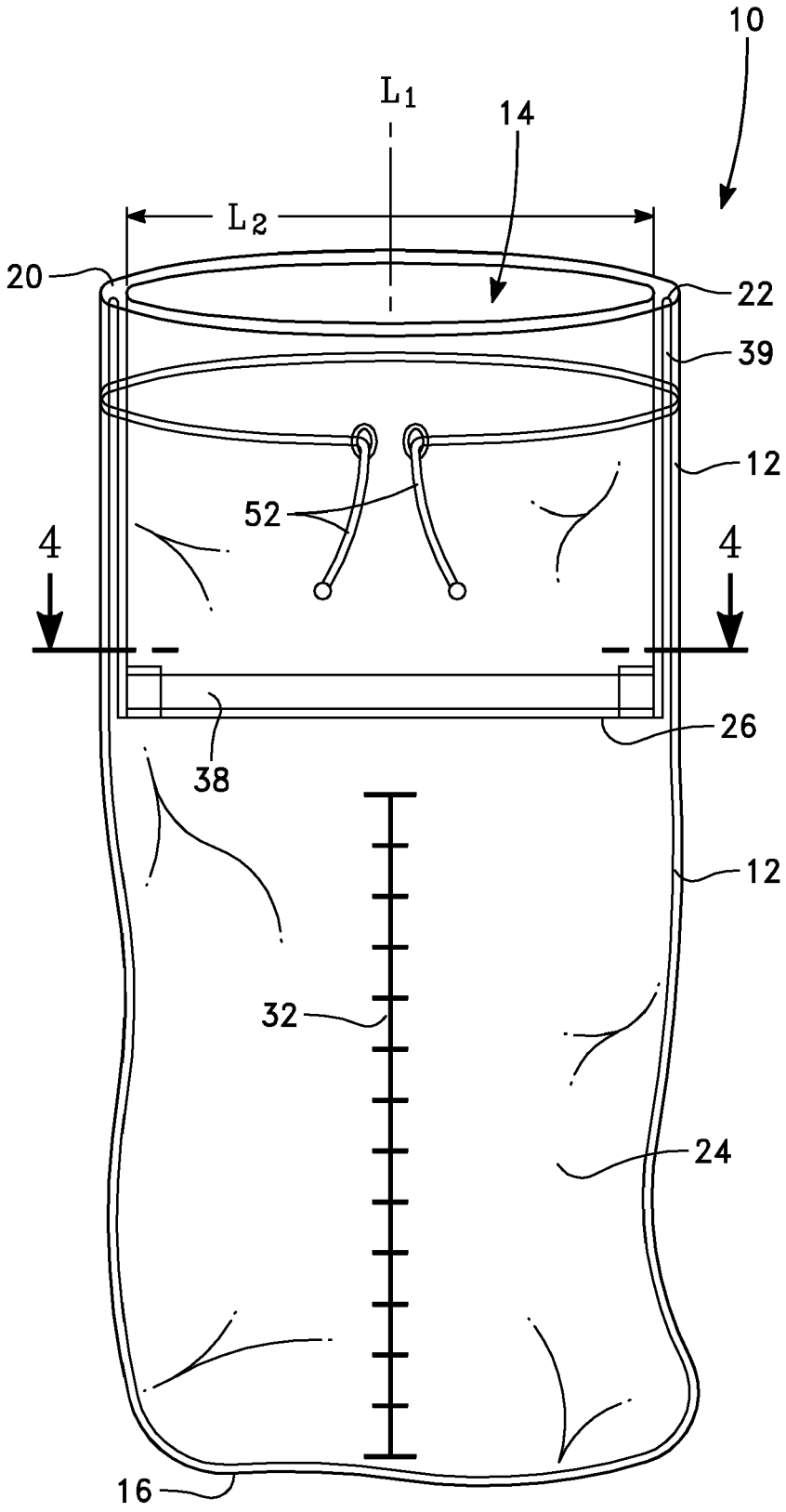
FIG. 2A shows a front sectional view of an embodiment of the apparatus, showing a view of the apparatus where the cross-wise axis L2 of the inner conduit is aligned with the cross-wise axis of the outer chamber.
Figure 2B:
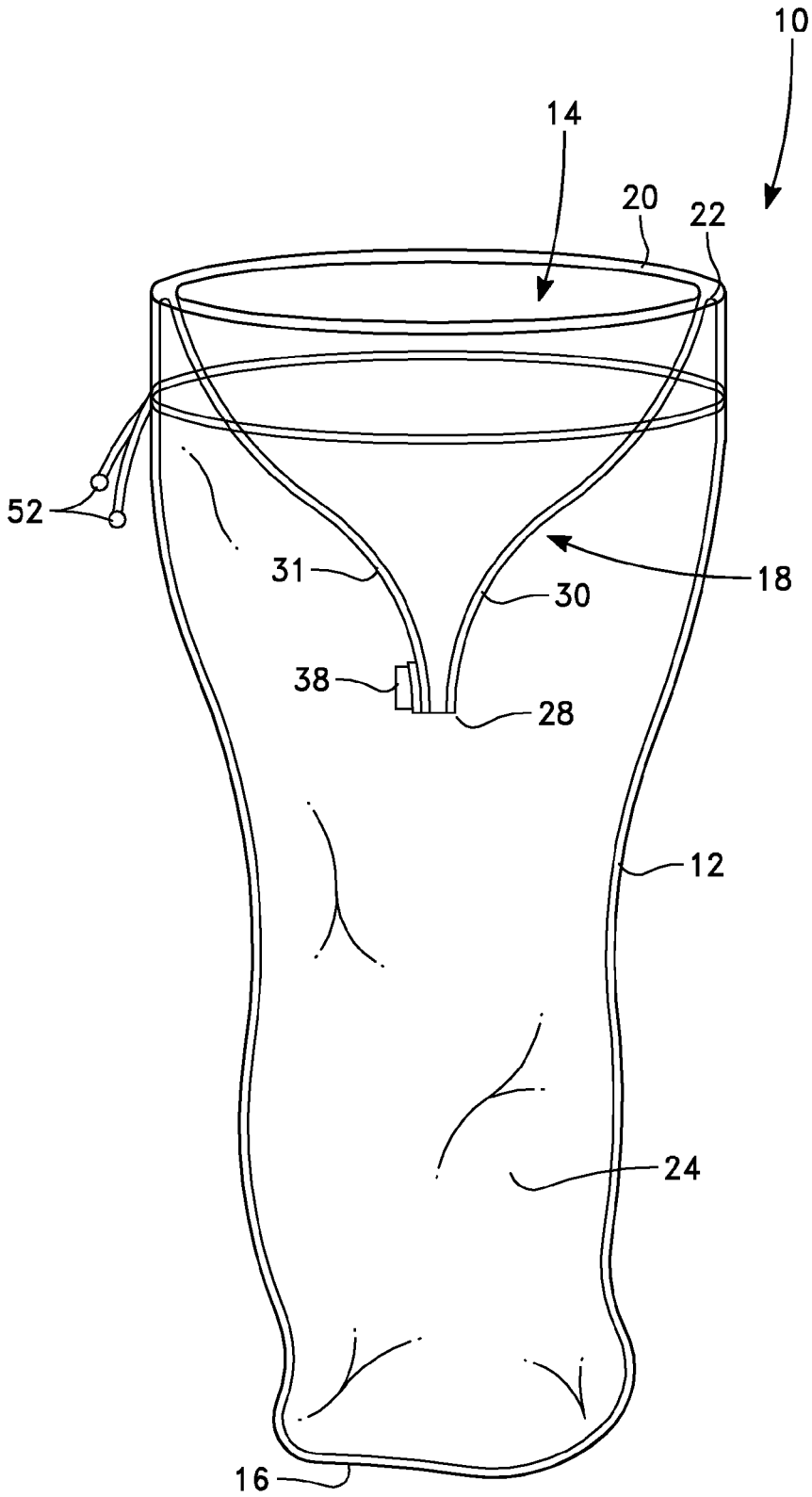
FIG. 2B shows a side sectional view of the embodiment shown in FIG. 2A, showing a side view of the inner conduit.

The inner conduit 18 may be fashioned from the same type of material as the outer chamber 12. The inner conduit 18 may be fashioned from a single piece of material, or may be fashioned from a plurality of sheets 30, 31 of material which are fused together along the longitudinal edges 36 of the material. In one embodiment, the inner conduit 18 may comprise two opposite facing sheets 30, 31 of flexible material, each sheet having generally the same shape and dimensions. The sheets 30,31 may be polygonal, including rectangular or trapezoidal, where the length-wise or longitudinal edges 36 of each sheet are fused to the length-wise edges of the opposing sheet. In order to function as a conduit, the top and bottom edges of each sheet 30,31 will not be attached to each other, such that an opening is defined at the top 20 of the inner conduit 18, and valve 28 is fashioned from the bottom edges of the sheets 30,31 as described below. As shown in FIGS. 2A, 2B, the opening of inner conduit 18 may coincide with opening 14 of the outer chamber 12. Alternatively, inner conduit 18 may be placed lower within outer chamber 12, such that the device has a greater volume of interim waste storage space before the waste W passes through valve 28 into the lower chamber 24. However, the top 20 of the inner conduit 18 will typically be in axial adjacency to the top 14 of the outer chamber 12.

Figure 3:
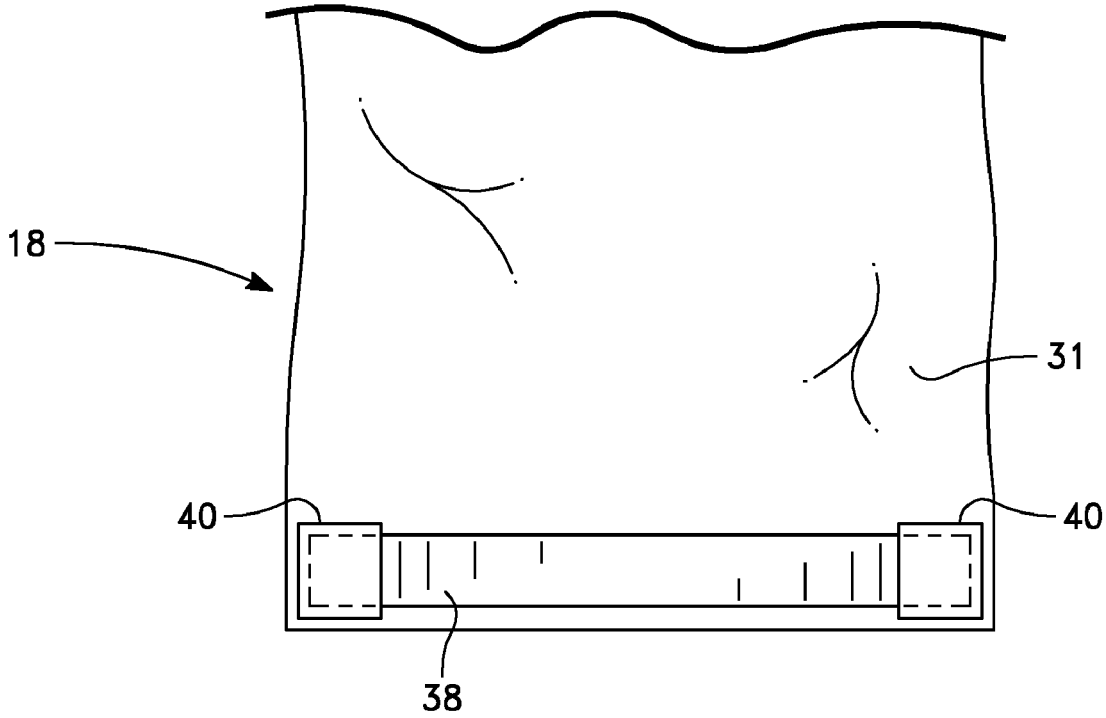
FIG. 3 shows close up view of the bottom of the inner conduit.
Figure 4:
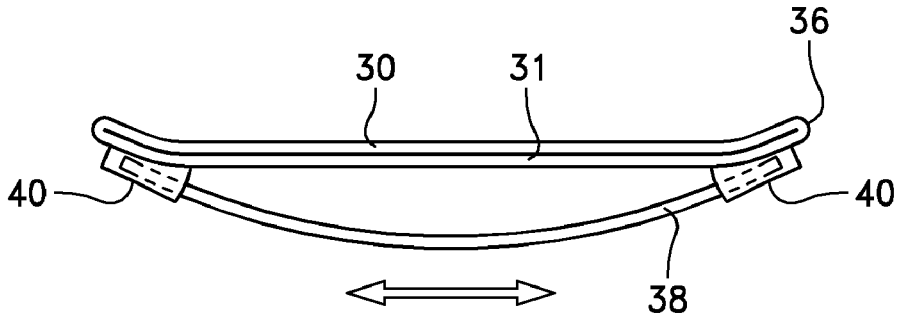
FIG. 4 shows a cross sectional view taken along lines 4-4 of FIG. 2.
Figure 5:
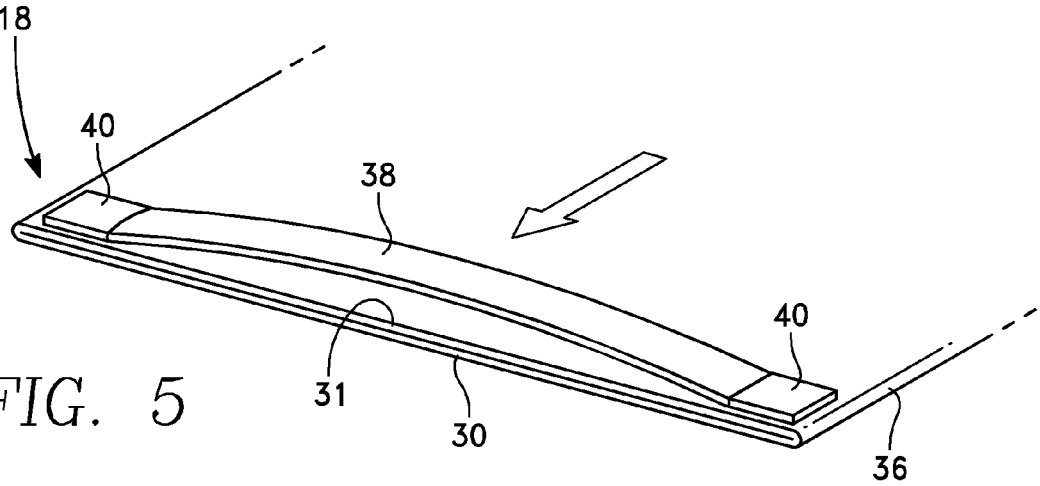
FIGS. 5-7 schematically show how the valve at the bottom of the inner conduit opens to allow material to flow through it in one direction (FIGS. 5-6), but prevents flow in the opposite direction (FIG. 7).
Figure 6:
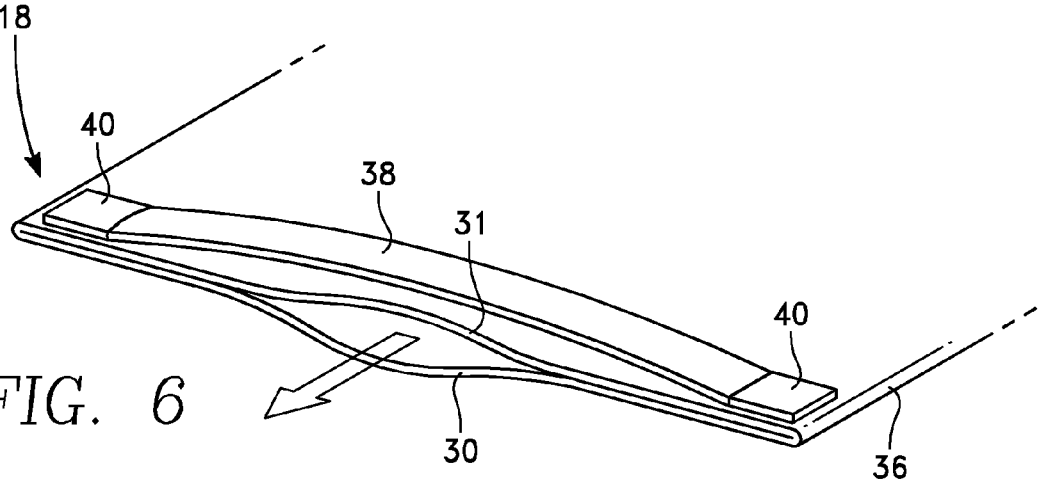
Figure 7:
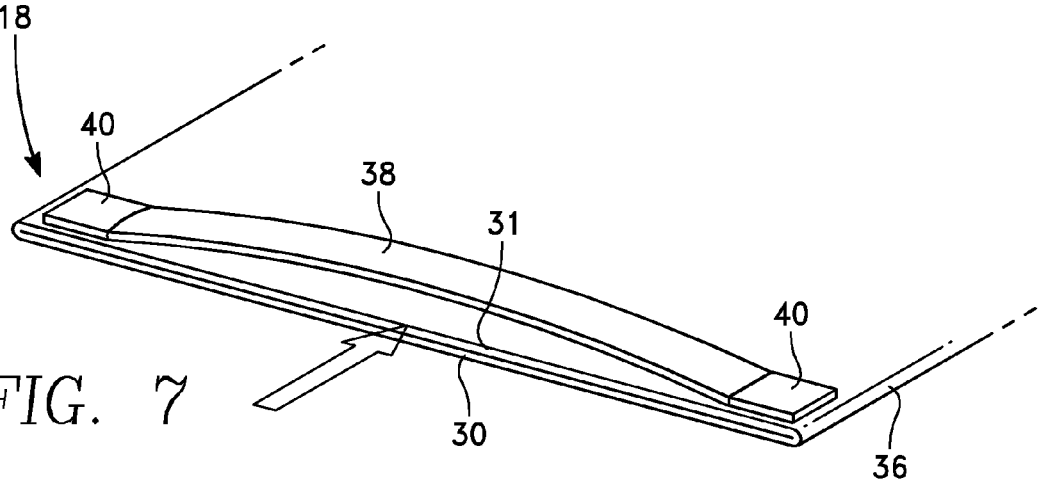

The bottom 26 of the inner conduit 18 comprises a biasing member 38 which attaches to the bottom edges of one of the sheets 31, such that the biasing member is in compression. The biasing member 38 may either be held in place by a pocket fashioned in the bottom edge of the sheet 31 or attached by thermal fusion or adhesive. The biasing member 38 may be attached in such manner that it is removable from the inner conduit, such as by forming a pocket 40 on either side of the bottom edge of sheet 31, as shown in FIGS. 3-4. When compressed between opposite corners of sheet 31, the biasing member 38 urges the opening at the bottom of the inner conduit into the closed position by causing the bottom edge of the flexible sheet 31 to which it is attached to buckle. Because the opposing sheet 30 is attached or fused along its edges 36 to the sheet 31 having the biasing member 38, the opposing wall 30 will also buckle in the same direction, thus urging the opening closed.

Figure 8:
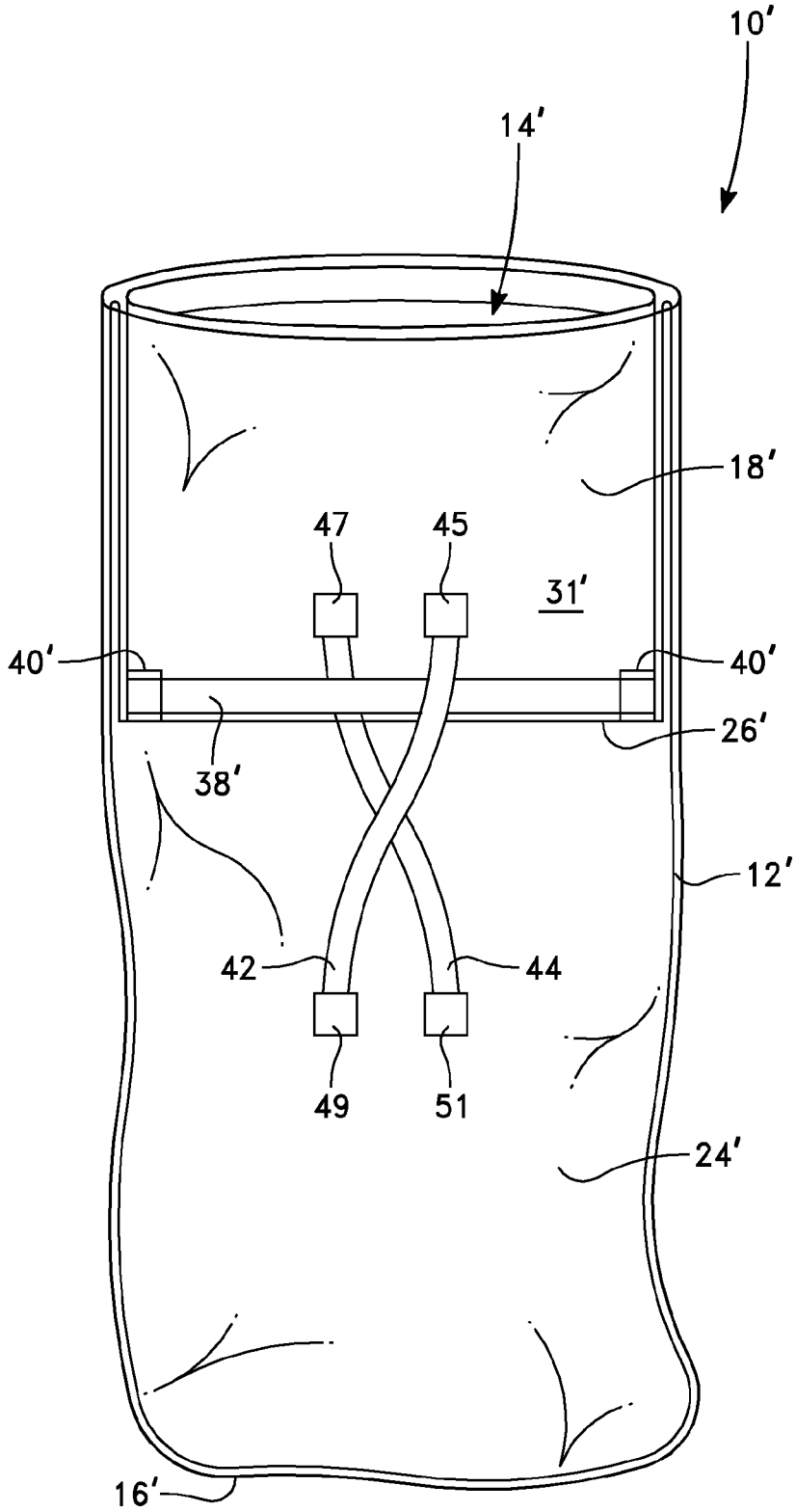
FIG. 8 shows a front sectional view of another embodiment of the apparatus, showing cruciate strips which may be utilized for maintaining the valve in a closed position.
Figure 9:
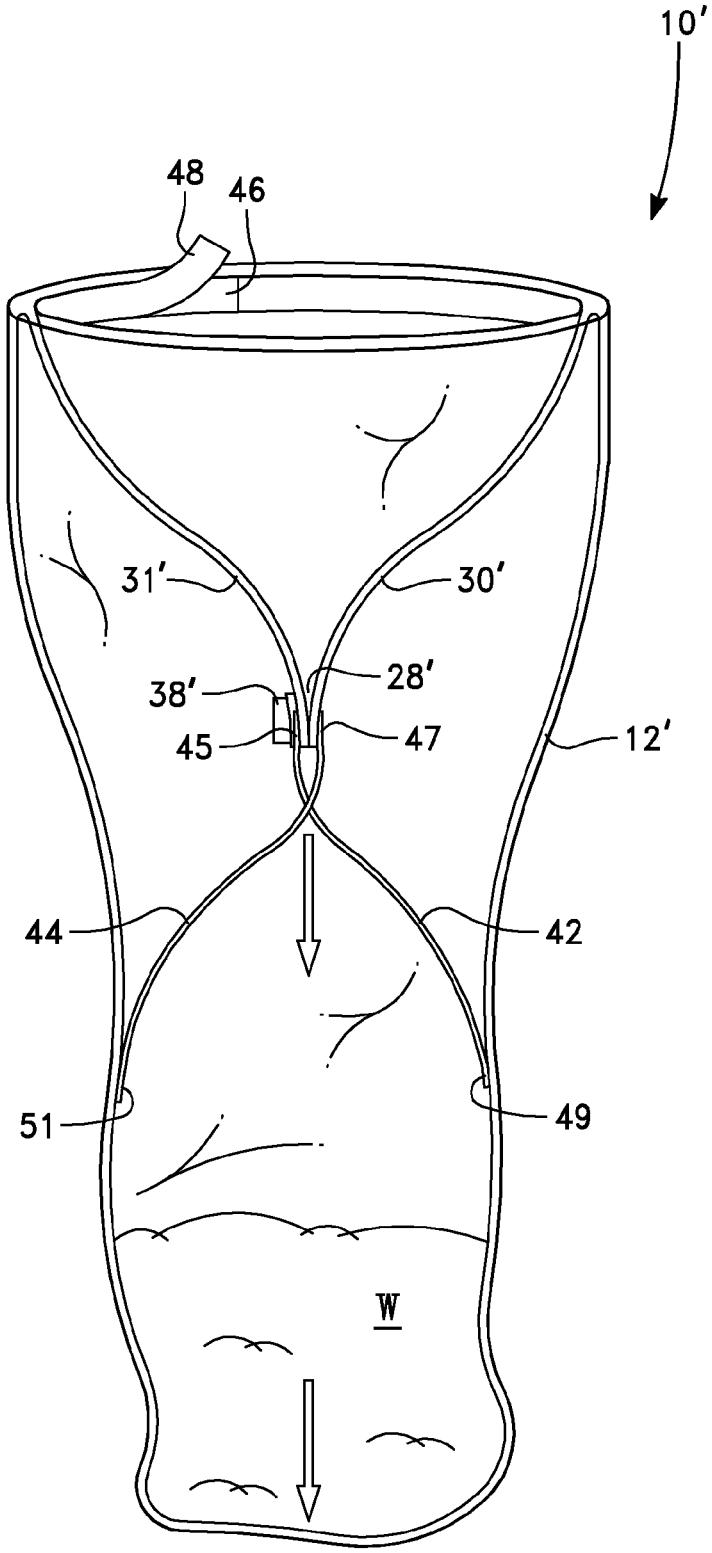
FIG. 9 shows a side sectional view of the apparatus shown in FIG. 8, after waste has been received, showing the attachment of the cruciate strips to the sides of the inner conduit and to the interior wall of the outer chamber.
Figure 10:
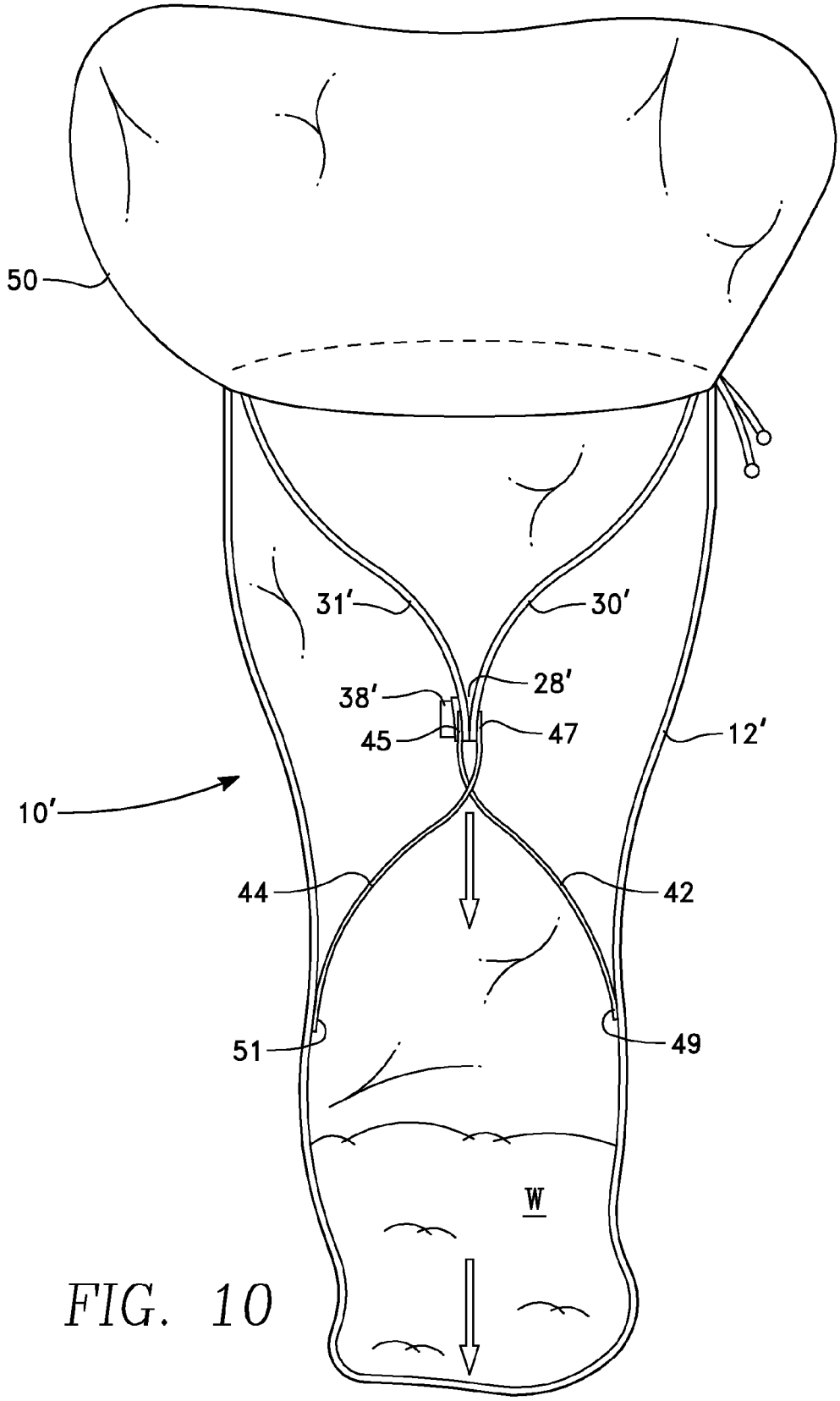
FIG. 10 shows the same apparatus as in FIGS. 8-9, but having a spill skirt attached at the top of the device.

Embodiments of the apparatus 10' may further comprise a pair of cruciate strips 42, 44. The end 45 of a first strip 42 may be attached to the outside of the inner conduit member 18' such as sheet 31' and the end 47 of a second strip 43 may be attached to the outside of the other sheet 30' of the inner conduit member 18', both strips attached in relatively close proximity to the opening at the bottom 26' of the inner conduit. The opposite end 49 of the first strip 42 and the opposite end 51 of the second strip 44 extend below the bottom 26' of the inner conduit 18'. The first strip 42 crosses below the bottom 26' of the inner conduit member 18' and attaches to the inside wall of the opposite facing sheet of the outer chamber 12'. Likewise, the second strip 44 crosses below the bottom 26' of the inner conduit member 18' to the inside wall of the opposite facing sheet of the outer chamber 18', such that the first and second strips cross below the 26' bottom of the inner conduit member as shown in FIGS. 8-10. With this arrangement, as the lower chamber 24' fills with waste W, the opposite facing walls of the outer chamber 12' will stretch, causing the cruciate strips 42, 44 to also stretch, thereby pulling the bottom edges of the sheets 30', 31' of the inner conduit member 18' closer together, thus improving the competency of the valve 28' at the bottom of the inner conduit member.

The outer chamber 12, 12' will typically comprise closure means for sealing the receptacle and its contents and, to some extent, its odors. The closure means may concurrently seal the top edges of the inner conduit, by using closure means 46, which may comprise adhesive tape 46 with removable backing 48, hook and loop fasteners, or other known closure means. The closure means may also comprise a draw string 52 or tie which fits within a peripheral pocket around the perimeter of top 14 of the outer chamber 12.

As shown in FIG. 10, the top 14 of the outer chamber 12 may comprise a flexible skirt 50 affixed at the opening of the outer chamber, the skirt providing a "funnel" into the opening. The skirt 50 may be shaped such that the device may be employed for a variety of services, such as incorporation into hospital gowns, diapers, underwear, shorts, pants, etc. The skirt 50 may comprise its own closure means at its top to prevent the spilling of any waste which may have collected between the top of the skirt and the valve 28'. The device may further comprise a carrying handle which loops around the outer chamber to facilitate carrying the apparatus.

The various components of the device are preferably fashioned from biodegradable plastics to facilitate responsible disposal of the waste material and the apparatus. However, the components may also be fabricated from treated paper, foil or other materials appropriate for the use.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A sealable waste disposal receptacle comprising:

an outer chamber comprising an outside surface, an inside surface, an open top and a closed bottom;

an inner chamber comprising a top, a bottom, a top opening, a bottom opening, the top opening in axial adjacency to the top of the outer chamber, the top sealingly attached to the outer chamber and depending there from and the bottom opening defined by a first edge and a second edge in parallel relation;

a lower chamber defined by the volume between the bottom opening of the inner chamber and the closed bottom of the outer chamber;

the bottom of the inner chamber comprising a first corner and a second corner wherein the first corner edge comprises a first pocket and the second corner comprises a second pocket; and a flexible member compressibly disposed between the first pocket and the second pocket, thereby applying sufficient force to the first corner and the second corner to bias the first edge and the second edge together in sealing contact.

2. The sealable waste disposal receptacle of claim 1 further comprising a pair of cruciate strips comprising a first strip and a second strip, each strip having a first end and a second end, the first end of the first strip attached to the inner chamber and the second end of the first strip attached to the inside surface of the outer chamber below the bottom opening of the inner chamber, the first end of the second strip attached to the inner chamber and the second end of the second strip attached to the inside surface of the outer chamber below the bottom opening of the inner conduit, wherein the first strip and the second strip cross below the bottom opening of the inner chamber.

3. The sealable waste disposal receptacle of claim 1 wherein the top opening of the inner chamber is flush with the open top of the outer chamber.

4. The sealable waste disposal receptacle of claim 1 wherein the inner chamber depends from the inner surface of the outer chamber.

5. The sealable waste disposal receptacle of claim 1 wherein the outer chamber comprises indicia for ascertaining the volume of a waste substance received into the lower chamber.

6. The sealable waste disposal receptacle of claim 1 wherein the outer chamber comprises closing means.

7. The sealable waste disposal receptacle of claim 6 wherein the closing means comprises a draw string.

8. The sealable waste disposal receptacle of claim 1 further comprising a skirt member removably attached to the open top of the outer chamber.

9. A sealable waste disposal receptacle comprising:

an outer chamber comprising a flexible material impervious to water, an inside surface, an outside surface, an open top and a closed bottom;

an inner conduit comprising a flexible material formed into a first sheet and a second sheet, wherein the first sheet and second sheet each comprise a top edge, a bottom edge, and a first length-wise edge and a second length-wise edge, the first sheet and the second sheet having generally the same shape and dimensions and corresponding length-wise edges, wherein the length-wise edges of the first sheet and the second sheet are attached together, and the top edge of the first sheet and the corresponding top edge of the second sheet define a top opening and the bottom edge of the first sheet and the corresponding bottom edge of the second sheet define a bottom opening, the top opening in axial adjacency to the top of the outer chamber, the top edges of the first sheet and second sheet sealingly attached to the outer chamber and depending there from;

a lower chamber defined by the volume between the bottom opening of the inner conduit and the closed bottom of the outer chamber;

the bottom edge of the first sheet further comprising a first corner adjacent to the first length-wise edge and a second corner adjacent to the second length-wise edge wherein the first corner edge comprises a first pocket and the second corner comprises a second pocket; and a flexible member compressibly disposed between the first pocket and the second pocket, thereby applying sufficient force to the first corner and the second corner to place the bottom edge of the first sheet in tension such that the bottom edges of the first sheet and the second sheet are biased together in sealing contact.

10. The sealable waste disposal receptacle of claim 9 wherein the top opening of the inner conduit is flush with the open top of the outer chamber.

11. The sealable waste disposal receptacle of claim 9 wherein the inner conduit depends from the inner surface of the outer chamber.

12. The sealable waste disposal receptacle of claim 9 wherein the outer chamber comprises indicia for ascertaining the volume of a waste substance received into the lower chamber.

13. The sealable waste disposal receptacle of claim 9 further comprising a pair of cruciate strips comprising a first strip and a second strip, each strip having a first end and a second end, the first end of the first strip attached to the first sheet and the second end of the first strip attached to the inside surface of the outer chamber below the bottom opening of the inner conduit, the first end of the second strip attached to the second sheet and the second end of the second strip attached to the inside surface of the outer chamber below the bottom opening of the inner conduit.

14. The sealable waste disposal receptacle of claim 9 wherein the outer chamber comprises closing means.

15. The sealable waste disposal receptacle of claim 14 wherein the closing means comprises a draw string.

16. The sealable waste disposal receptacle of claim 1 further comprising a skirt member removably attached to the open top of the outer chamber.

* * * * *